US005337818A

United States Patent [19]

Coad

[11] Patent Number: 5,337,818

[45] Date of Patent: Aug. 16, 1994

[54] ROLLAWAY EXTENDABLE PLANAR FABRIC CLOSURE

[75] Inventor: George L. Coad, Lafayette, Calif.

[73] Assignee: Richard A. Lang, Lafayette, Calif.

[21] Appl. No.: 82,463

[22] Filed: Jun. 28, 1993

[51] Int. Cl.[5] ..... E04F 10/06

[52] U.S. Cl. ..... 160/66; 160/120; 160/DIG. 8; 296/98

[58] Field of Search ..... 160/66, 265, DIG. 8, 160/122, 238, 242, 243, 245, 120, 67; 296/98

[56] References Cited

U.S. PATENT DOCUMENTS

| | | | |
|---|---|---|---|
| 208,700 | 10/1878 | Wookey . | |
| 1,769,272 | 7/1930 | Peaden . | |
| 1,788,173 | 1/1931 | Shevlin | 160/56 |
| 3,628,826 | 12/1971 | Sibley | 296/98 |
| 4,050,734 | 9/1977 | Richard | 296/98 |
| 4,651,797 | 3/1987 | Lange | 160/290 |
| 4,821,786 | 4/1989 | Johnston | 160/23.1 |
| 4,838,332 | 6/1989 | Mlenek | 160/90 |

*Primary Examiner*—Blair M. Johnson

*Attorney, Agent, or Firm*—George W. Wasson

[57] ABSTRACT

A rollaway opening closure and more particularly a fabric opening closure adapted to be stored in a reeled or rolled position and to be unrolled from the reel to close the opening. The apparatus includes a roller, a drawbar, a sheet of fabric and at least one pivoted bar link. The axis of the roller, the drawbar and the pivot of the bar link are maintained parallel as the fabric is unrolled from the roller. The drawbar and the bar link are structurally attached. The fabric is attached to the roller and the drawbar but unattached to other elements of the apparatus. A rotational biasing means biases the fabric into rolled position on the roller and causes the fabric to be maintained taught when unrolled and in closing position at an taught when unrolled and in closing position at an opening.

8 Claims, 2 Drawing Sheets

ROLLAWAY EXTENDABLE PLANAR FABRIC CLOSURE

FIELD OF THE INVENTION

This invention relates to a rollaway opening closure and more particularly to a rolled fabric opening closure that is adapted to be stored in a reeled or rolled position and to be unrolled from the reel to an extended, stable position covering the opening. The mechanism used in accomplishing the purposes of this invention is useful in providing a closure for framed openings whether the opening is rectangular, triangular or circular and regardless of whether the movement of the planar fabric is from a horizontal axis, a vertical axis or an overhead axis.

BACKGROUND OF THE INVENTION

Many rollable door or window closures or coverings have been known including those illustrated in U.S. Patents:

| | | |
|---|---|---|
| 208,700 | Wookey | October 8, 1878 |
| 1,769,272 | Peaden | July 1, 1930 |
| 1,788,173 | Shevlin | January 6, 1931 |
| 4,651,797 | Lange | March 24, 1987 |
| 4,821,786 | Johnston | April 18, 1989 |
| 4,838,332 | Mlenek | June 13, 1989 |

The Lange patent discloses a roller mounted at one edge of the opening, a stiffening strip on the leading edge of the fabric, and a hook at the other edge of the opening. It is left to the operator to pull the leading edge across the opening and find the hook without guidance.

The Johnston patent discloses a similar scheme with the addition of linear guidance means where a drawbar fixed to the leading edge of the fabric is guided linearly in a track across the opening. The spring bias of the roller tends to retract the fabric so a latch is both needed and provided to hold the fabric in the closed position.

None of these issued patents suggest a reelable, extendable fabric closure that is stored in a reeled position and extended to a opening closure position with the ability to cover the opening and rest in the extended position without being latched. Further the known issued patents do not suggest a structure that includes as few as three moving parts and no guides.

Openings in the form of doors or windows come in many different forms and shapes including hinged or sliding doors and windows. In some of these forms there is a minimal amount of space for accomodating additional closures for the openings in the form of screens or storm panes. The provision of additional closures for such openings is further complicated if the opening is oriented in an unconventional orientation or is in an other than rectangular shape. While closures, particularly in the form of screens, have been designed for such openings, the mounting of the closure is usually a substantially permanent mounting without provision for ease of opening or closing and without provision for allowing unobstructed access through the opening. Hinged closures for the conventional hinged rectangular door require separate hinges for the closure and the allowance of space for the second hinged closure to swing. In the case of sliding doors, a separate track is needed for the sliding closure and the framing of the closure must be adapted to withstand the forces for moving the closure through the tracks. A more complicated problem is encountered with doors known of as French Doors where two doors hinged at opposite sides of an enclosure meet in the middle when closed and open the entire opening when opened. In each of the foregoing structures for doors, the suggested closure or screen is a separate structure that is always in the opening whether needed or not; that is, the screen or the like is not retracted when not in use.

SUMMARY OF THE INVENTION

In the present invention an extendable planar fabric closure for covering openings such as doorways is disclosed with the closure including a spring biased roller on which the fabric is wrapped and a 180 degree swingable linkage that guides the leading edge of the fabric in an arc parallel to the roller from the stored or reeled position on the roller to the extended position closing the opening or doorway. The roller used in storing and controlling the fabric is rotatably mounted at or adjacent to one edge of the opening on an axis so as to be rotatably supported at the edge of the opening. The roller includes an internal mechanism for biasing the rotational position of the roller and the fabric attached to the roller in a reeled or wrapped position around the roller. The fabric is pulled or unrolled from the roller by the linkage to form a planar sheet of the fabric for closing the opening. The linkage is pivoted on a pivot axis that is parallel to the axis of the roller with the pivot axis being adapted to toggle the linkage to cause the fabric to be taught in its unrolled position and to cause the linkage to be carried back to the roller as the fabric is reeled onto the roller. In the usual form of the structure, a drawbar is fixed to the moving end of the linkage and the fabric is attached to the drawbar. The drawbar engages a stop in the open position and is held against the stop by the rotational bias of the mechanism within the roller so as to provide a tension on the fabric.

The immediate advantage of the structure of the extendable planar fabric closure as just described is that it is substantially completely out of the opening when not is use. Further, there are no guides or channels that the fabric tracks as the fabric is unrolled, the fabric is carried to the position of covering the opening by the movement of the drawbar and linkage and, with the toggle action of the linkage, the fabric is maintained taught across the opening and tight against the frame of the opening when in the extended position.

An object of the present invention is to provide a retractable planar fabric closure that is stable in both the extended and retracted positions and that has linkage to guide the fabric in extension and retraction so the operator need provide only motive power without dexterity or visual accuity.

Another object of the present invention in accord with the preceding object is to provide an extendable planar fabric closure for covering an opening with a structure that will permit the fabric to be completely reeled when not in use and will permit the fabric to be taught and tight against an opening when unreeled for covering the opening.

A further object in accord with the preceding objects is an extendable planar fabric closure that is operable with a minimum of force for opening and closing.

A further object in accord with the preceding objects is an extendable planar fabric closure that can be adapted to be installed in a variety of openings without regard for the three dimensional orientation of the opening.

A further object in accord with the preceding objects is an extendable planar fabric closure that can be adapted to be installed in a variety of openings whether the opening is rectangular, triangular or a part of a circle.

BRIEF DESCRIPTION OF THE DRAWINGS

Further objects and features of the invention will be readily apparent to those skilled in the art from the appended drawings and specification illustrating preferred embodiments wherein.

DESCRIPTION OF THE PREFERRED EMBODIMENTS

Figure 1:
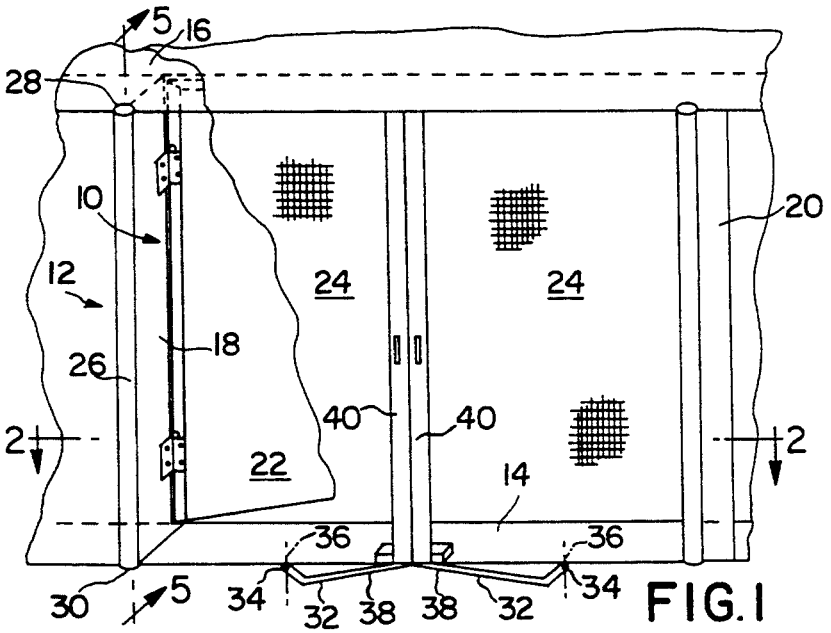
FIG. 1 is elevational perspective view of a framed enclosure with the installation of an extendable planar fabric closure of the present invention.

FIG. 1 illustrates in perspective the installation of an extendable planar fabric closure 10 of the present invention on a framed opening 12. As illustrated, the opening 12 has a base or sill 14 and a header 16 with spaced side members 18 and 20 to define the opening. In the form here illustrated, the opening 12 is provided with a pair of hinged door panels 22 that are hinged to open into the plane of the view of the drawing away from the viewer. In the form shown the hinged door panels are commonly known as a French Door. It should be understood that the door panels and their operation forms no part of the present invention except that the door panel is moved in some way to open the framed opening. In another form, the door panels may be sliding panels that move from side to side rather that about a hinge as just described; the sliding doors may open only half of the opening or may be "pocket doors" that slide within the framing of the opening to open the entire opening.

The extendable planar fabric closure 10 of the present invention includes a fabric material 24 that has top, bottom and two parallel side edges. The fabric is flexible and has one of the parallel edges fixed to a roller 26 so as to be adapted to be reeled onto and off of a roller 26 and extendable to totally close a portion of the opening 12 where the roller 26 is installed. As used herein, "extendable" is intended to mean that the fabric extends across the opening, "planar" is intended to describe the fabric when extended as a substantially firm, but flexible, closure of the opening, and "closure" is intended to define the extended fabric when enclosing the opening as completely closing the opening (or portion thereof).

Figure 2:
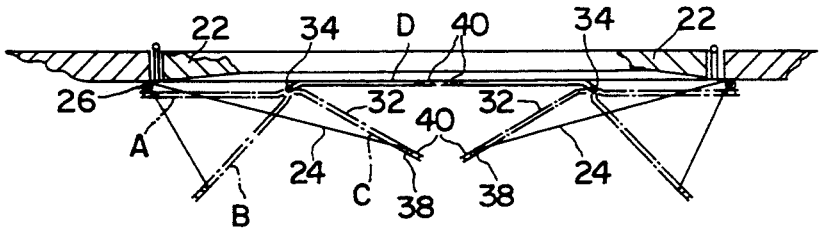
FIG. 2 is a plan view taken along the lines 2—2 of FIG. 1.

The roller 26 is generally shaft-like and rotatably supported axially at its ends 28 and 30 within or adjacent to aside member 18 or 20 of a framed opening 12. The position of the roller 26 within in the framing depends upon the type of framed opening and the type of door panels within that opening. An important part of the mounting of the roller 26 is that it is at one side of the opening and in close proximity with a side member so as to locate the fabric 24 in position to produce an effective seal against that side member or a sealer associated with that side member. As illustrated in FIGS. 1 and 2, the roller 26 is at one face of the framed opening 12. As will be more fully explained hereinafter, the roller includes a rotational biasing means that biases the roller for rotation about its mounting axis so that the roller is adapted to unwind to an extended position for the fabric 24 and to be returned to its position with the fabric 24 reeled onto the roller when the roller is unrestrained.

Figure 3:
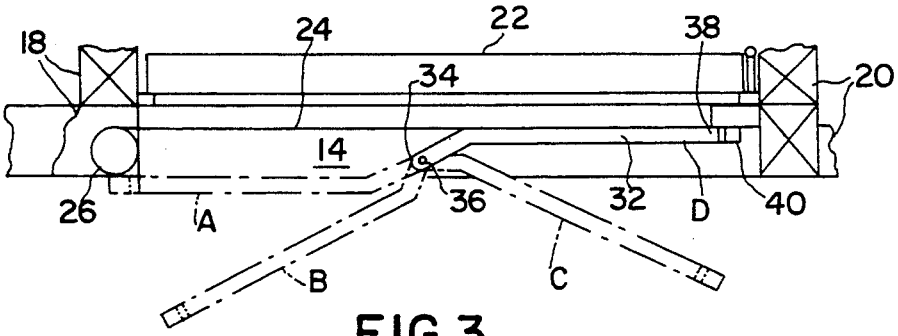
FIG. 3 is a plan view of an installation of the closure of the present invention on a conventional hinged door.

The operating mechanism for extending and positioning the fabric 24 as a closure is seen in FIGS. 1, 2 and 3 where FIGS. 2 and 3 illustrate the mechanism in plan. The mechanism includes at least one bar link 32 having a pivoted end 34 and a movable end 38. The pivoted end 34 is pivoted on an axis at 36 in or adjacent to the sill 14 (or header) of the framed opening 12. The movable end 38 of the bar link 32 is attached to a drawbar 40. The other parallel edge of the fabric 24 is attached to the drawbar 40 so as to cause the fabric to be reeled onto or off of the roller 26 as the drawbar is moved with respect to the framing of the opening 12. In a preferred form the bar link 32 is one half of the dimension of the opening 12 to be closed and the position of the axis 36 is midway between the axis of the roller 26 and the edge or frame of the opening to be closed. Movement of the drawbar 40 causes the bar link 32 to be pivoted about its axis 36 and to move the bar link 32 in an arc about the axis 36 so as to move the movable end 38 of the bar link between a position closing the opening 12 and a position resting against the roller 26 with the fabric 24 reeled onto the roller 26 under the bias of the rotational biasing force exerted on the roller. FIGS. 2 and 3 illustrate four positions of the bar link 32 as the drawbar 40 is moved from its position adjacent to the roller 26 to its position in contact with a frame portion of the opening 12. The four positions are identified as positions A, B, C and D with A being adjacent to the roller 26, B and C being positions of travel as the fabric is unreeled from the roller, and D being the position of closure for the opening 12.

A particular feature of the bar link 32 and the position of its axis 36 for rotation with respect to the roller 26 and the framing of the opening 12 is the offset bend 42 at the pivoted end 34 of the bar link 32. By referring to the illustration of FIGS. 3 and 4 it may be seen that when the drawbar 40 is in its position D of closing of the opening 12 it has traveled substantially 180 degrees of rotation about the axis 36 and that the fabric 24 is stretched from the perimeter of the roller 26 to the inside of the drawbar 40 and that the axis 36 of rotation for the bar link 32 is beyond the 180 degree rotation of the drawbar 40. The result of this rotation and position of the axis is that the orientation of the drawbar 40, roller axis 28-30 and the axis 36 of the bar link 32 has gone through an over-center action and that the bias exerted by the rotational biasing means of the roller 24 is now exerting a force pressing the drawbar 40 against the frame of the opening 12. This same force also causes the bottom and top edges of the fabric 24 to be pressed against the sill 14 and header 16, respectively, of the framed opening thus insuring a substantially sealed closure of the opening 12.

When the drawbar 32 is rotated from its closed position D to its reeled position A the rotational biasing force of the roller 26 further assists in actuating the operating mechanism of the present invention. It should be evident that the over-center action that causes the drawbar 40 and fabric 24 to be sealed against the opening in the D position operates with the same force to reel the fabric 24 back onto the roller 26 when the closure 10 is opened. A slight movement of the drawbar 40 from the position D through the alignment of the drawbar 40, the axis 36 and the roller 24 axis passes the drawbar 40 through the over-center position and causes the rotational biasing force of the roller 26 to accelerate the drawbar 40 through positions C and B to the reeled position A. This use of the roller biasing force provides an ergonomic balance to the operation of the extendable planar fabric closure and makes the closure easily openable while providing a positive closing action once the over-center position has been passed.

Figure 4:
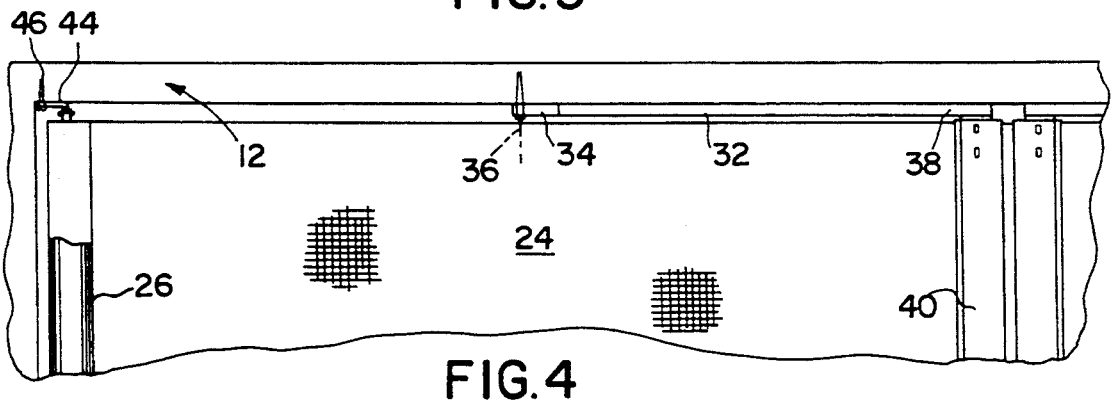
FIG. 4 is an enlarged elevational view of a closure installation as shown in FIG. 1.

FIG. 4 illustrates the installation of a bar link 32 at the top of a framed opening 12 and in a French Door installation as illustrated in FIG. 1. The present invention contemplates the bar link element at both top and bottom of an installation. With the two bar links 32 and a rigid connection to the drawbar 40 provides a stable and rigid formation for the operating mechanism. It should be evident that the bar links 32 at the top and bottom are reasonably thin stock and become substantially contained within the framing of the opening. The pivot of a bar link 32 on the sill of a doorway is held in place by a fastener at the axis 36 which may be a flat head screw operating within a recess in the pivot face of the bar link. The bar link will be flat against the sill framing of the opening in the reeled position A as shown in FIG. 3 and will be equally flat against the sill in the closed position D of FIG. 3. As seen in FIG. 4, the bar link 32 will be within the framing of the opening and will not interfere with the sealing of the fabric against the frame.

Figure 5:
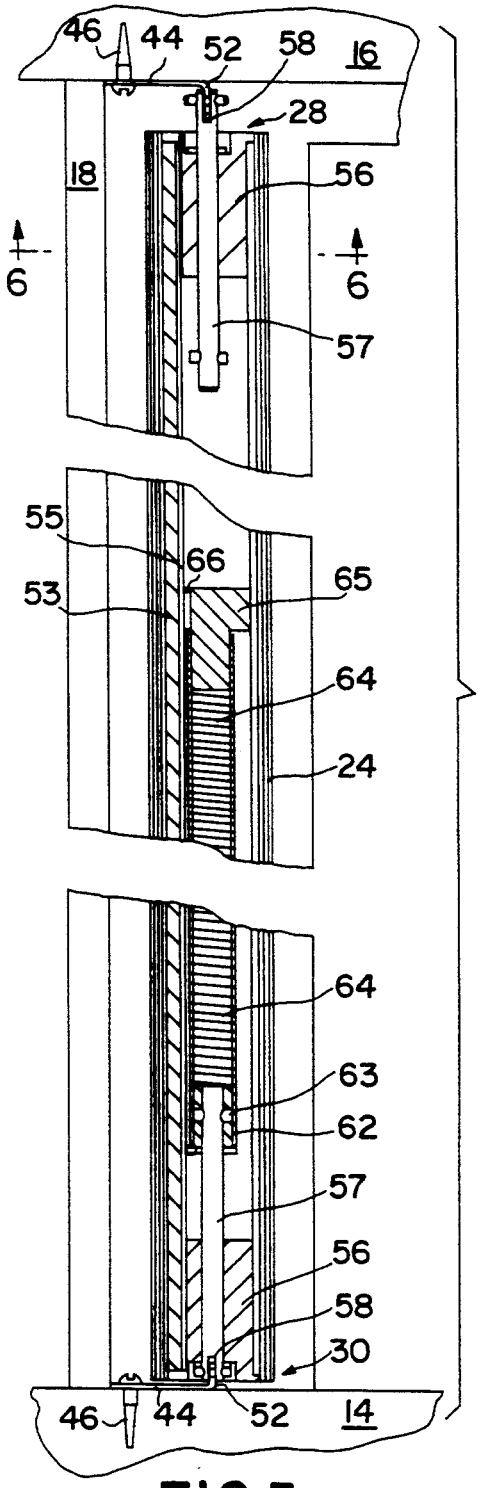
FIG. 5 is an axial sectional view through a roller of the present invention taken along the lines 5—5 of FIG. 1.

FIG. 5 illustrates the biasing mechanism and the mounting of the roller 26 within a framed opening. As here illustrated, brackets 44 attached by mounting screws 46 are provided in the header 16 for engagement with the the top end 28 of the roller 26 and in the sill 14 for engagement with the bottom end 30 of the roller 26. The internal mechanism that provides the rotational biasing force as the fabric 24 is unreeled from the roller 26 may be the conventional mechanism used in window shades without the usual "stop" feature of the shade mechanism.

Figure 6:
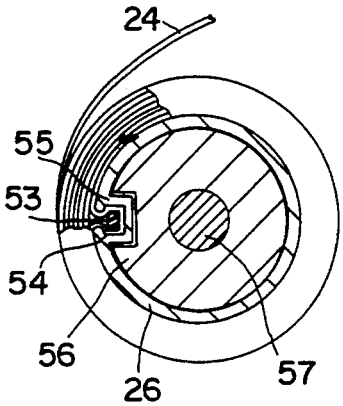
FIG. 6 is a sectional view taken along the lines 6—6 of FIG. 5.

The roller 26, as shown in cross-section in FIG. 6, is a generally hollow tube or cylinder with an axial external slot 54 which also forms an internal axial boss 55 on the inside of the hollow roller. The axial external slot 54 is adapted to receive a folded portion of the fabric 24 and a keeper bar 53 for holding one edge of the fabric on the roller. Notched bearings 56 are pressed into each end of the hollow roller 26; the notches in the bearings cooperate with the internal axial boss 55 to hold the bearing stationary. When fully assembled, a pair of axial pins 57, on at each end of the roller, are rotatably supported within the bearings 56. The end of the pins 57 extending out of the bearings 56 and the roller 26 are slotted transversly at 58 for cooperation with a flat tab 52 on a mounting fastner 44 adapted to be attached by screw 46 to the framing of an opening.

Before the bearings 56 and pins 57 are mounted within the roller 26, one end of the roller 26 has a rotational biasing mechanism 60 assembled within the roller. The biasing mechanism 60 includes a collar 62 fixed by pin 63 to the inward end of a pin 57, a spring 64, and a torquer 65 with an axial slot 66 adapted to cooperate with a portion of the internal axial boss 55 of the roller 26. The spring 64 is press fit at one end around the body of the collar 62 and is press fit at the other end around the body of the torquer 65; both press fittings being adequate to prevent the spring 64 from rotating on the collar 62 or torquer 65.

When assembled as shown in FIG. 5 and mounted within, or on a framed opening 12, the transverse slots 58 cooperate with (or are pined to) the flat tab 52 of the mounting fastener 44 that is adapted to be attached to the framed opening 12 as by suitable screws 46 as shown. When the roller 26 is rotated about its axis as when the fabric 24 is rolled off of the roller 26, the pins 57 remain stationary and the roller 26 rotates. As the roller 26 rotates, the torquer 65 is rotated with the roller causing the upper end of spring 64 (FIG. 5) to rotate; the lower end of the spring 64 (FIG. 5) is fixed to the collar 62 and pin 57 so as to be held stationary. Rotation of one end of the spring 64 causes the spring to become wound and to exert a rotational bias between the roller 26 and the pin 57; that bias exerts a force on the roller tending to return the roller to its original position. The roller assembly is adaptable for rotation of the roller 26 in either direction by merely being inverted in its mounting within the framed opening.

The forgoing rotational biasing mechanism is actuated as the fabric 24 is unrolled from the roller 26 as the assembly of the present invention is moved away from the rolled position to the position of closing the opening. Further, when the fabric is unrolled and aligned so that its plane is passed through an over-center position of the roller axis, the axis 36 of the bar link 32 and the position of the drawbar 40, the rotational bias of the biasing mechanism exerts a force tending to press the drawbar 40 against a stop on sill 14 or header 16. When drawbar 40 is moved in reverse through that overcenter position, the biasing mechanism causes the fabric to be reeled onto the roller 26 until the drawbar 24 engages the roller 24.

Figure 7:
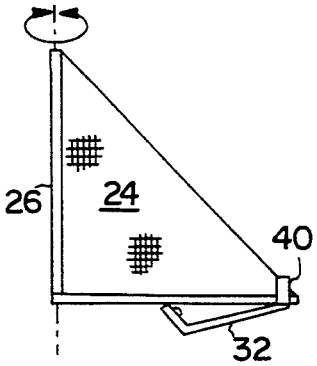
FIGS. 7, 8 and 9 are illustrations of closures that may be constructed in accord with the present invention for alternative forms of openings.
Figure 8:
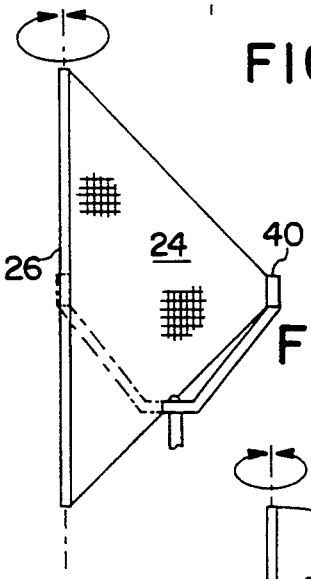
Figure 9:
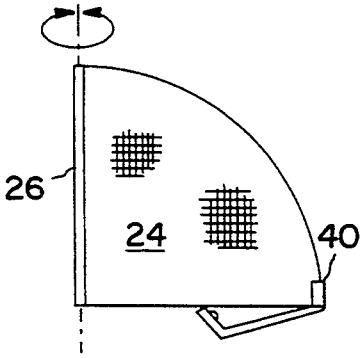

FIGS. 7, 8 and 9 illustrate the extendable planar fabric closure of the present invention as it could be installed on a framed opening of different configurations. FIG. 7 illustrates a triangular opening with the roller 26 mounted on one of the legs of the triangle and the bar link 32 mounted on another leg. A much shorter drawbar 40 is provided at the junction of the leg of the triangle with the bar link and the hypotenuse of the triangle. FIG. 8 illustrates an alternative triangular installation. FIG. 9 illustrates the apparatus when used on an opening in the form of a portion of a circle. In this installation the roller 26 is along a radius (or diameter) of the circle and the bar link 32 is along another radius; a shortened drawbar 40 is provided and the circumference of the fabric may need a stiffener to maintain it taught around the perimeter of the opening.

The feature of the present invention that causes it to function properly is the alignment of the axis of the roller 26, the axis 36 of the bar link 32, and the axis of the draw bar 40. Those axes must be parallel for the fabric to unroll and reroll smoothly on the roller 26. However, it should be apparent that because gravity forms no part in the operation of the mechanism, the extendable planar fabric closure can function with the axis of the roller horizontal, vertical or variations thereof as well as overhead, such as with a skylight. For that reason, the mechanism may be used in an overhead opening or on a sloping surface such as a roof vent. The operating space needed for opening and closing the closure is minimal in that the space needed to roll and unroll the fabric from the roller can be as small as one half of the linear dimension of the opening being closed. The bar link 32 is pivoted at the center of the opening and the maximum space needed for the rolling is that dimension of the bar link. The opening to be covered can be rectangular, triangular or a part of circle so long as the axes are parallel and the bar link and drawbar can have space to be moved.

The fabric 24 rolled on the roller may take many forms including clear or reflective solid sheets, woven fabrics, as well as transparent or opaque sheets. The fabric need only be flexible to permit it to be rolled and unrolled from the roller.

A further feature of the mechanism of the present invention is that the force needed to operate the closure is minimal and no hand grasping or dexterity is needed to open the closure. A force exerted any where on the closure that will cause the drawbar to pass beyond the over-center position will cause the biasing force of the roller to reel the fabric onto the roller. Also, because the fabric is only attached to the drawbar and the roller and is not attached at the nominal top and bottom of the closure, any force exerted against the fabric in a direction opposite to an opening direction will only flex the fabric and not bend a frame of damage the fabric. It is expected that users with a minimum of power will be able to operate the closure with ease.

While a coil spring rotational biasing means has been disclosed and described it should be understood that other forms of biasing means could be used. For example, a torsion bar could be substituted for the coil spring or a motor powered device could be employed within the roller or at the mountings. Also, the biasing means could function on the pivot axis of the bar link either as a spring biasing means or a motor powered operator.

While certain preferred embodiments of the present invention have been specifically disclosed, it should be understood that the invention is not limited thereto as many variations will be readily apparent to those skilled in the art and the invention is to be given its broadest possible interpretation within the terms of the following claims.

I claim:

1. An extendable planar fabric closure comprising:

a) a roller, a pair of supports, said roller being rotatably supported at the ends thereof on said supports, said roller having a rotational extended position and a rotational retracted position, said roller including means for rotationally biasing said roller to said rotational retracted position on said supports, b) a drawbar having ends and at least a portion thereof parallel to said roller, c) a sheet of fabric having edges, d) said fabric being fixed to said roller at one edge and fixed at another edge to said drawbar, said fabric being rollable onto said roller in a retracted position and being unrollable from said roller to an extended position establishing an extended plane of said fabric, said fabric being drawn taught between said roller and said drawbar by said means for rotationally biasing said roller, e) at least one bar link having a movable end and a fixed end, said fixed end of said bar link being pivoted on an axis, and said movable end of said bar link being fixed to said drawbar, f) said axis of said pivoted end of said bar link being offset to said extended plane of said fabric when said fabric is in said extended position from said roller, said offset of said axis of said bar link being selected to both maintain said fabric in said extended position under said biasing of said roller.

2. An extendable planar fabric closure and a framed opening having spaced apart members defining a plane for said framed opening, said closure comprising:

a) a shaft-like roller, a pair of supports, said roller being rotatably supported at the ends thereof on said supports on at least one member of said framed opening, said roller having a rotational extended position and a rotational retracted position, said roller including means for rotationally biasing said roller to said retracted position on said rotatable supports, b) a shaft-like drawbar having ends and at least a portion thereof parallel to said roller, c) a sheet of fabric having top, bottom, and side edges, d) said fabric being fixed at one of said side edges to said roller and fixed at the opposite side edge to said drawbar, said fabric being rollable onto said roller in said retracted position and being unrollable from said roller to an extended position establishing an extended plane of said fabric, said fabric being drawn taught between said roller and said drawbar by said biasing of said roller to said retracted position, e) at least one bar link having a movable end and a pivoted end, said pivoted end of said bar link being pivoted on one of said members of said framed opening, f) and said movable end of said bar link being fixed to an end of said drawbar in a manner to maintain said drawbar parallel to said roller, said pivot of said pivoted end of said bar link being offset to said plane of said framed opening when said fabric is drawn from said roller to said extended position, said offset of said pivot of said bar link being selected to both maintain said fabric in said extended position and to move said fabric to said retracted position under said biasing of said roller, (g) said offset of said pivot being in a positon with respect ot said plane of said framed opening and said roller to cause said fabric to pass through an over-center alignment with respect to said pivot when said fabric is in said extended position.

3. The extendable planar fabric closure of claim 2 wherein said pivot of said bar link is at the center of said framed opening, said bar link being adapted to move about said offset pivot to position said drawbar against said roller when said fabric is rolled onto said roller and against a member of said framed opening when said fabric is fully drawin from said roller by said biasing of said roller.

4. The extendable planar fabric closure of claim 2 having a pair of bar links, one bar link of said pair attached at each end of said drawbar, and each bar link having a pivoted end substantially at the center of said framed opening at a position offset with respect to said plane of said framed opening.

5. The extendable planar fabric closure of claim 2 wherein said framed opening has vertical and horizontal members establishing said plane of said framed opening an said roller is pivoted on one of said horizontal members adjacent to one of said vertical members, said bar link is pivoted on said offset pivot on a horizontal member, and said drawbar is movable with said bar link to a position adjacent to said roller at said vertical member and to a position adjacent to another parallel vertical member of said framed opening to place said fabric across said framed opening in a taught planar extended position by said biasing of said roller.

6. The extendable planar fabric closure of claim 2 wherein said bar link is a substantially rigid member having an offset portion adjacent to its pivoted end, and offset of said offset portion of said bar link and said offset of said pivot of said bar link being adapted to pass said fabric through said over-center alignment of said roller support and said pivot and to position said drawbar against another member of said framed opening when said fabric is unrolled from said roller, and said bias of said biasing means of said roller causing said drawbar to be biased against said another member of said framed opening to insure fabric closure of said framed opening by said biasing of said roller.

7. The extendable planar fabric closure of claim 1 wherein said means for rotational biasing said roller is a coiled spring within said roller, said spring being adapted to maintain said fabric taught between said roller and said drawbar as said fabric is rolled onto said roller to said retracted position or unrolled from said roller to said extended position, and said pivot of said pivoted end of said bar link with respect to said roller being adapted to place said fabric in a taught at rest position between said roller and said drawbar when said fabric is unrolled from said rolled by said biasing of said roller.

8. In an extendable planar fabric closure for a framed opening having framing members establishing a plane for said framed opening and having means for supporting said planar fabric closure at one edge of said framed opening on a rotationally spring biased roller, a means for unwrapping said fabric from said roller to an extended position and for positioning said extended fabric in an at rest position across the plane of said framed opening comprising:

a) a pivoted bar link member having a pivoted end and a movable end, said movable end being adapted to be rotated with respect to said pivoted end about said pivot through an arc of substantially 180°, said pivoted end being pivoted on a pivot adjacent to a framing member of said framed opening, said pivot being offset with respect to the plane of said framed opening, said offset of said pivot being in a position with respect to said plane of said framed opening and said roller to cause said fabric to pass through an over-center alignment with respect to said pivot when said fabric is in said extended position, b) and a drawbar firmly attached to said movable end of said bar link so as to maintain said drawbar in continuous alignment with said framed opening as said drawbar is rotated with said bar link about said pivot, c) said offset pivot of said pivoted bar link and said attachment of said drawbar to said bar link causing said fabric to be wrapped onto and unwrapped from said roller to said at rest position of said extended fabric across said plane of said framed opening under rotational bias exerted by said spring bias of said spring biased roller.

* * * * *